US007784552B2

(12) United States Patent
Brouse

(10) Patent No.: US 7,784,552 B2
(45) Date of Patent: Aug. 31, 2010

(54) LINER DRILLING METHOD

(75) Inventor: Michael Brouse, Houston, TX (US)

(73) Assignee: Tesco Corporation, Houston, TX (US)

( * ) Notice: Subject to any disclaimer, the term of this patent is extended or adjusted under 35 U.S.C. 154(b) by 152 days.

(21) Appl. No.: 12/238,191

(22) Filed: Sep. 25, 2008

(65) Prior Publication Data

US 2009/0090508 A1 Apr. 9, 2009

Related U.S. Application Data

(60) Provisional application No. 60/977,263, filed on Oct. 3, 2007.

(51) Int. Cl.
*E21B 23/00* (2006.01)

(52) U.S. Cl. ..... 166/382; 166/285

(58) Field of Classification Search ..... 166/382, 166/385, 177.4; 175/57
See application file for complete search history.

(56) References Cited

U.S. PATENT DOCUMENTS

| | | | | |
|---|---|---|---|---|
| 3,163,238 | A | 12/1964 | Malott | |
| 5,074,366 | A | 12/1991 | Karlsson et al. | |
| 5,425,423 | A * | 6/1995 | Dobson et al. | 166/278 |
| 5,957,225 | A | 9/1999 | Sinor | |
| 6,095,261 | A | 8/2000 | Trevino, Jr. | |
| 6,138,774 | A | 10/2000 | Bourgoyne, Jr. et al. | |
| 6,241,018 | B1 * | 6/2001 | Eriksen | 166/215 |
| 6,412,574 | B1 | 7/2002 | Wardley et al. | |
| 6,543,552 | B1 | 4/2003 | Metcalfe et al. | |
| 6,742,606 | B2 | 6/2004 | Metcalfe et al. | |
| 6,854,533 | B2 | 2/2005 | Galloway et al. | |
| 6,857,487 | B2 | 2/2005 | Galloway et al. | |
| 6,899,186 | B2 | 5/2005 | Galloway et al. | |
| 7,013,997 | B2 | 3/2006 | Vail, III | |
| 7,036,610 | B1 | 5/2006 | Vail, III | |

(Continued)

FOREIGN PATENT DOCUMENTS

| | | |
|---|---|---|
| CA | 2538196 | 8/2006 |

(Continued)

OTHER PUBLICATIONS

Drilling Liner Technology for Depleted Reservoir, C. Vogt, SPE and F. Makohl, SPE, Baker Hughes INTEQ; P. Suwamo, SPE and B. Quitzau, SPE, Mobil Oil Indonesia—SPE 36827—pp. 127-132.

(Continued)

*Primary Examiner*—David J Bagnell
*Assistant Examiner*—Catherine Loikith
(74) *Attorney, Agent, or Firm*—Bracewell & Giuliani LLP

(57) ABSTRACT

An installation system for installing a liner in a well includes drilling while simultaneously running the liner. A string of drill pipe with a bottom hole assembly including a drill bit on a lower end is lowered into the liner while the liner is suspended at the rig floor. The bottom hole assembly engages a lower sub of the liner for torque transmission. A running tool secured to the drill pipe engages the upper sub such that the running tool supports the weight of the liner and transmits torque. The drill pipe and liner are rotated to drill deeper into the wellbore. The liner hanger can be set to engage the casing, then released and reset at a different point.

17 Claims, 5 Drawing Sheets

U.S. PATENT DOCUMENTS

| | | | |
|---|---|---|---|
| 7,040,420 | B2 | 5/2006 | Vail, III |
| 7,048,050 | B2 | 5/2006 | Vail, III et al. |
| 7,083,005 | B2 | 8/2006 | Galloway et al. |
| 7,093,675 | B2 | 8/2006 | Pia |
| 7,100,710 | B2 | 9/2006 | Vail, III |
| 7,108,080 | B2 | 9/2006 | Tessari et al. |
| 7,108,084 | B2 | 9/2006 | Vail, III |
| 7,117,957 | B2 | 10/2006 | Metcalfe et al. |
| 7,147,068 | B2 | 12/2006 | Vail, III |
| 7,165,634 | B2 | 1/2007 | Vail, III |
| 7,228,901 | B2 | 6/2007 | Vail, III |
| 7,234,542 | B2 | 6/2007 | Vail, III |
| 7,311,148 | B2 | 12/2007 | Giroux et al. |
| 7,334,650 | B2 | 2/2008 | Giroux et al. |
| 2001/0017210 | A1 | 8/2001 | Howlett |
| 2005/0103525 | A1 | 5/2005 | Sangesland |
| 2006/0196695 | A1 | 9/2006 | Giroux et al. |
| 2007/0007014 | A1 | 1/2007 | Sessions et al. |
| 2007/0175665 | A1 | 8/2007 | Tessari et al. |
| 2007/0267221 | A1 | 11/2007 | Giroux et al. |
| 2009/0090508 | A1 | 4/2009 | Brouse |
| 2009/0101345 | A1 | 4/2009 | Moffitt et al. |

FOREIGN PATENT DOCUMENTS

| | | | |
|---|---|---|---|
| WO | WO2007/011906 | A1 | 1/2007 |

OTHER PUBLICATIONS

Simultaneous Drill and Case Technology—Case Histories, Status and Options for Further Development, by Detlef Hahn, Baker Hughes Inteq, Wilhelmus Van Gestel, BP Amoco Norway AS, Norbert Frohlich, Baker Hughes Inteq., Glenn Stewart, Baker Hughes Inteq—SPE International, IADC/SPE 59126, Feb. 23-25, 2000, pp. 1-9.

Weatherford "R Running Tool with Hydraulically Released Mechanical Lock", 2006, pp. 1-2.

Drilling Contractor "Liner Drilling Technology Being Prepared for Offshore", Jan./Feb. 2004, pp. 14-15.

Dril-Quip LS-15 Liner Hanger System, Sales Manual, pp. 5-7.

TIW "Liner Equipment" HLX Liner-Top Packer, pp. 5, 9-11, 18-19.

Dril-Quip "LS-15 Liner Hanger System", pp. 1-2, 4 and 6.

U.S. Appl. No. 11/461,248, filed Jul. 31, 2006.

U.S. Appl. No. 12/275,396, filed Nov. 21, 2008.

U.S. Appl. No. 12/347,610, filed Dec. 31, 2008.

U.S. Appl. No. 12/347,443, filed Dec. 31, 2008.

World Oil/Oct. 1999—Drilling Technology "Casing-while-Drilling: The Next Step Change in Well Construction", pp. 34-36 and 38-40.

Rotary Steerable Drilling with Liner—during 2007 or later based on the text—Randi Elisabeth Hugdahl, Leader, TNE RD RCT DWPT—pp. 3-5.

* cited by examiner

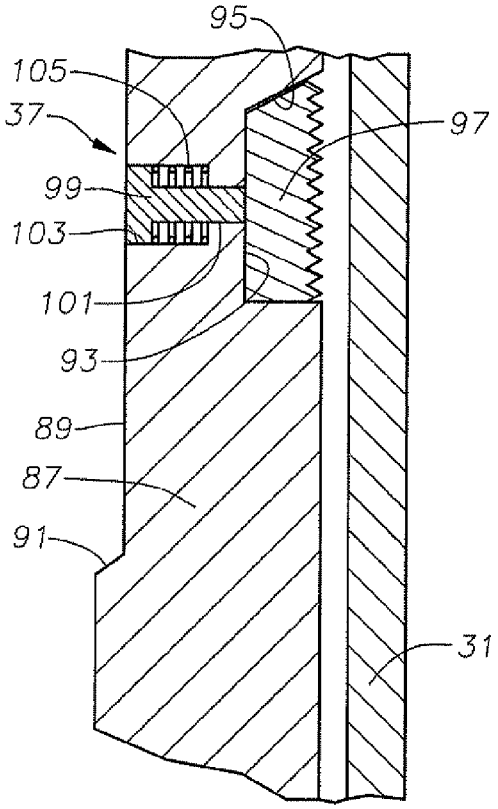
Fig. 7
Fig. 8
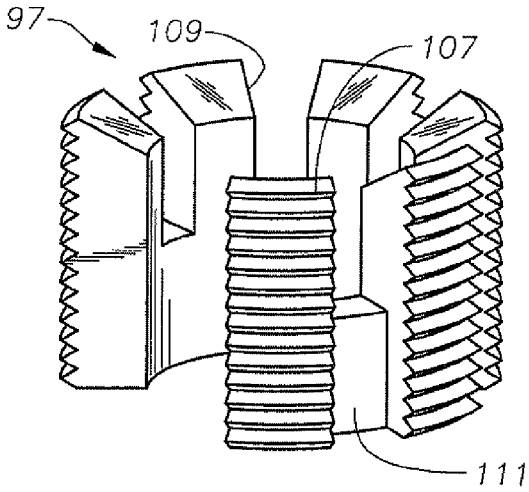
Fig. 9
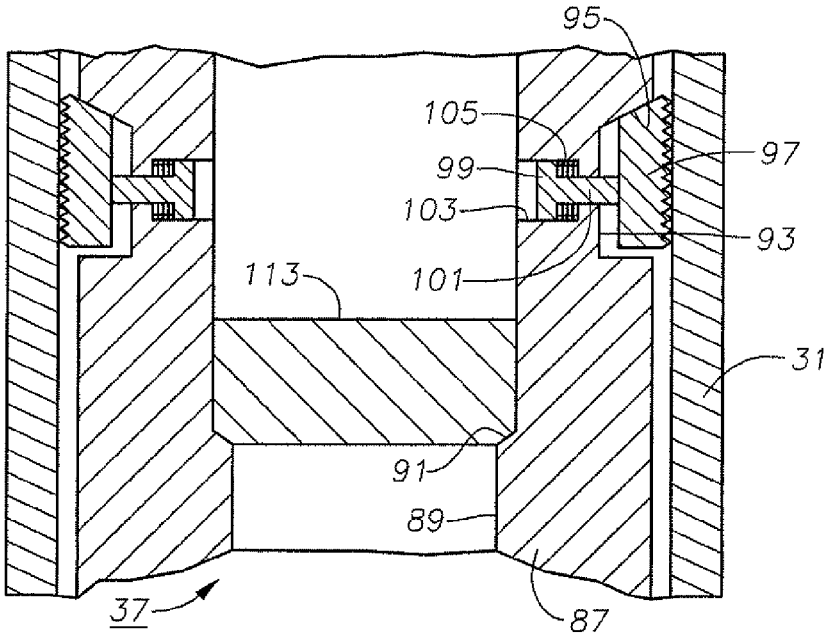

LINER DRILLING METHOD

CROSS-REFERENCE TO RELATED APPLICATION

This application claims priority to provisional patent application 60/977,263 filed Oct. 3, 2007.

FIELD OF THE INVENTION

This invention relates in general to oil and gas well drilling while simultaneously installing a liner in the well bore.

BACKGROUND OF THE INVENTION

Oil and gas wells are conventionally drilled by drilling with drill pipe to a certain depth, then running and cementing casing in the well. The operator may then drill the well to a greater depth with drill pipe and cementing another string of casing. In this type of system, each string of casing extends to the surface wellhead assembly, whether on land or subsea.

In some wells, an operator may install a liner rather than an inner string of casing. The liner is made up of joints of pipe in the same manner as casing. Also, the liner is cemented into the well, normally. However, a liner does not extend back to the wellhead assembly at the surface. Instead, it is secured to the last string of casing near the lower end of the casing by a liner hanger.

In most cases, the operator drills the well to the desired depth, retrieves the drill string, then assembles and lowers the liner into the well. A liner top packer may also be incorporated with the liner hanger. A cement shoe with a check valve will normally be secured to the lower end of the liner as the liner is made up. When the desired length of liner is reached, the operator attaches a liner hanger to the upper end of the liner, and attaches a running tool to the liner hanger. The operator then runs the liner into the wellbore on a string of drill pipe attached to the running tool. The operator sets the liner, then pumps cement through the drill pipe, down the liner and back up an annulus surrounding the liner. The cement shoe prevents backflow of cement back into the liner. The running tool dispenses a wiper plug following the cement to wipe cement from the interior of the drill pipe and the liner at the conclusion of the cement pumping. The operator then sets the liner top packer, if used, releases the running tool from the liner, and retrieves the drill pipe.

A variety of designs exist for liner hangers. Some may be set in response to mechanical movement of the drill pipe, including rotation. Others may be set by dropping a ball or dart into the drill string, then applying fluid pressure to the interior of the string after the ball or dart lands on a seat in the running tool. The running tool may be attached to the liner hanger or body of the running tool by threads or by a hydraulically actuated arrangement.

In another method of installing the liner, the operator runs the liner while drilling the wellbore simultaneously. This method has been done in the past but is not commonly employed. A related technology, known as casing drilling, is performed regularly. In casing drilling, a bottom hole assembly at the lower end of the casing includes a drill bit that performs the drilling while the casing is rotated. The operator rotates the casing via a casing gripper at the surface that is suspended from a top drive assembly of a top drive drilling rig. The bottom hole assembly may be retrievable and it may include measuring-while-drilling instruments, directional drilling steering equipment, and a reamer. The bottom hole assembly can be retrieved and rerun by wireline, drill pipe, or pumping the bottom hole assembly down and back up.

Liner drilling differs from casing drilling in that a string of smaller diameter drill pipe is attached to the liner since the liner does not intended extend all the way back to the wellhead assembly at the surface or the subsea wellhead or housing at the sea floor. If the operator wishes to retrieve the bottom hole assembly before cementing the liner, there are no established methods and equipment for doing so. Also, if the operator wishes to rerun the bottom hole assembly and continue drilling with the liner, there are no established methods and equipment for doing so.

SUMMARY

In this invention, the operator makes up a liner string with a lower sub on bottom joint of the liner string and suspends the liner in the well at the rig floor. The operator makes up a string of drill pipe with a bottom hole assembly, which includes a drill bit on the lower end, and a telescoping sub having an adjustable length above the bottom hole assembly. The operator lowers the drill pipe, the bottom hole assembly and the telescoping sub into the liner and engages the bottom hole assembly with the lower sub such that torque may be transmitted between the bottom hole assembly and the lower sub. A running tool is connected to the drill pipe and the drill pipe is lifted or lowered to align the running tool with an upper end of the liner. The telescoping sub contracts or extends to allow this step to occur without releasing the engagement between the bottom hole assembly and the lower sub. Once aligned, the running tool engages with the upper end of the liner such that the running tool supports the weight of the liner and torque may be transmitted between the liner and the running tool;

The operator rotates the drill pipe and the liner to drill the wellbore. When at a desired depth, the operator disengages the bottom hole assembly from the bottom hole sub and the running tool from the liner and retrieves the bottom hole assembly and the running tool. The liner may then be cemented into the wellbore.

Preferably the bottom hole assembly engages with the bottom hole sub by moving the drill pipe straight downward and engaging torque keys of the bottom hole assembly with torque slots in the lower sub. The telescoping sub preferably has upper and lower portions that are axially movable relative to each other. The telescoping sub has a non-torque transmitting mode wherein the upper portion is rotatable relative to the lower portion, so as to allow the running tool to be rotated to engage the upper sub without rotating the bottom hole assembly. At the total depth for the liner, the operator sets the liner hanger and retrieves the bottom hole assembly.

A cementing tool is lowered on the drill pipe into engagement with the upper end of the liner. The cementing tool has upper and lower cement plug members. Before cementing, the operator pumps the lower cement plug member down from the cementing tool into engagement with the lower sub. Then cement is pumped through the drill pipe, down the liner, through the lower cement plug member and up an annulus surrounding the liner. The upper cement plug member is pumped down following the cement.

If it is desired to retrieve and rerun the bottom hole assembly before reaching the total depth, the liner hanger is actuated to grip the casing and suspend the liner. The operator releases the running tool from the upper sub, releases the bottom hole assembly from the lower sub and retrieves the bottom hole assembly. The operator reruns the drill pipe and new or repaired bottom hole assembly back into the liner and reengages the bottom hole assembly with the lower sub and the running tool with the upper sub. The operator releases the liner hanger from gripping engagement with the casing and continues drilling.

BRIEF DESCRIPTION OF THE DRAWINGS

FIG. 7 is an enlarged simplified quarter sectional view of the liner hanger of the system of FIG. 1.

FIG. 8 is a perspective view of slips for the liner hanger of FIG. 7.

FIG. 9 is a simplified sectional view of the liner hanger of FIG. 7, but showing the liner hanger being set.

DETAILED DESCRIPTION OF THE INVENTION

Figure 1A:
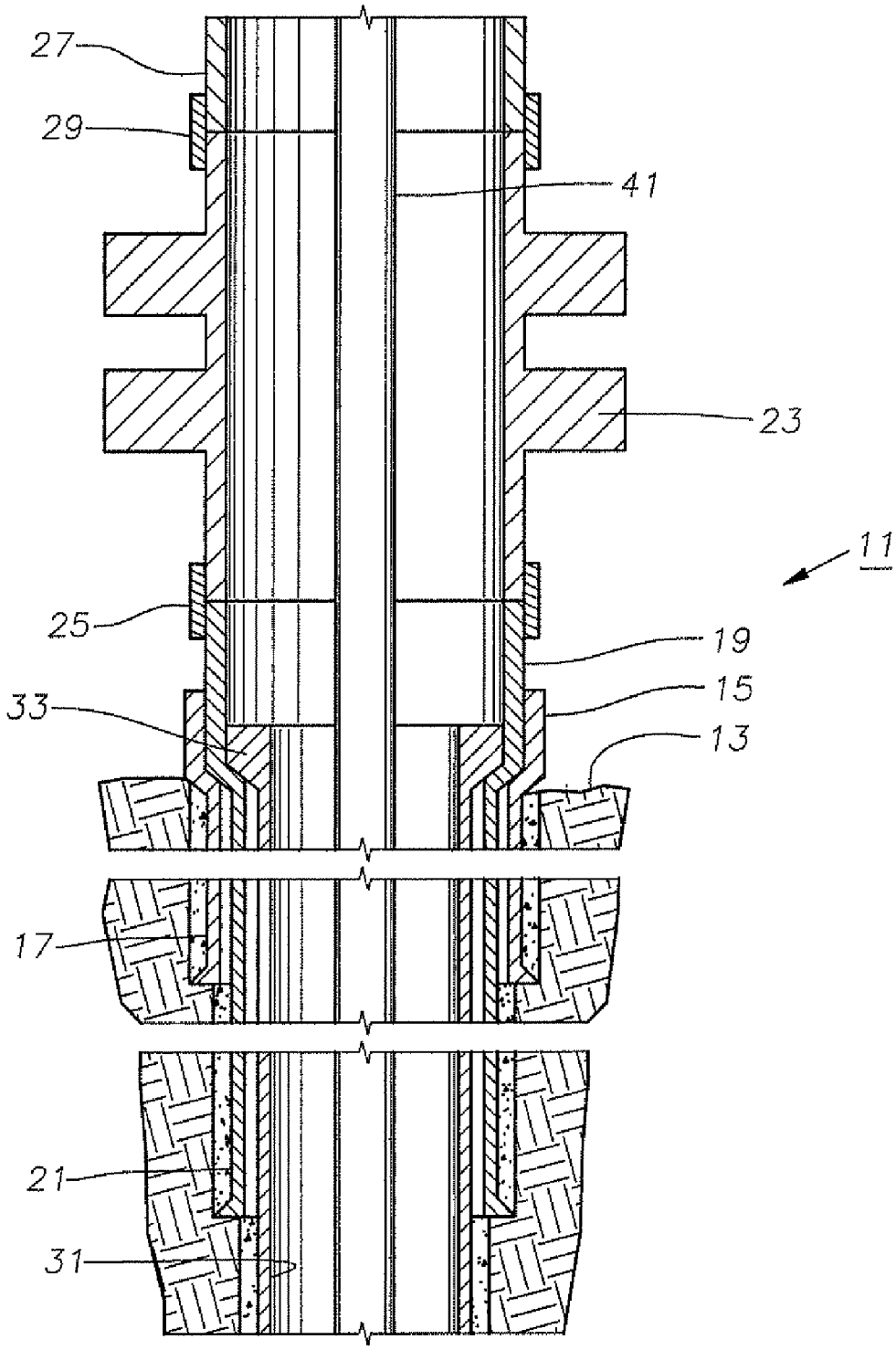
FIGS. 1A and 1B comprise a schematic view of a well being drilled while simultaneously installing a liner.

FIG. 1A shows a typical subsea wellhead assembly 11 during drilling. Subsea wellhead assembly 11 is at sea floor 13 and includes an outer wellhead housing 15 secured to a first string of casing or conductor pipe 17 that extends to a first depth in the well. An inner or high pressure wellhead housing 19 is shown landed in outer wellhead housing 15. Inner wellhead housing 19 is secured to a second string of casing 21 that extends to a second depth in the well.

A blowout preventer or lower marine riser package 23 is secured to the upper end of inner wellhead housing 19 by a connector 25. Blowout preventer 23 is connected to a drilling riser 27 that extends upward to a drilling platform, which may be floating or fixed. The drilling platform may have a riser tensioner system that maintains tension in riser 27. Riser 27 is connected to blowout preventer 23 by a connector 29.

Figure 1B:
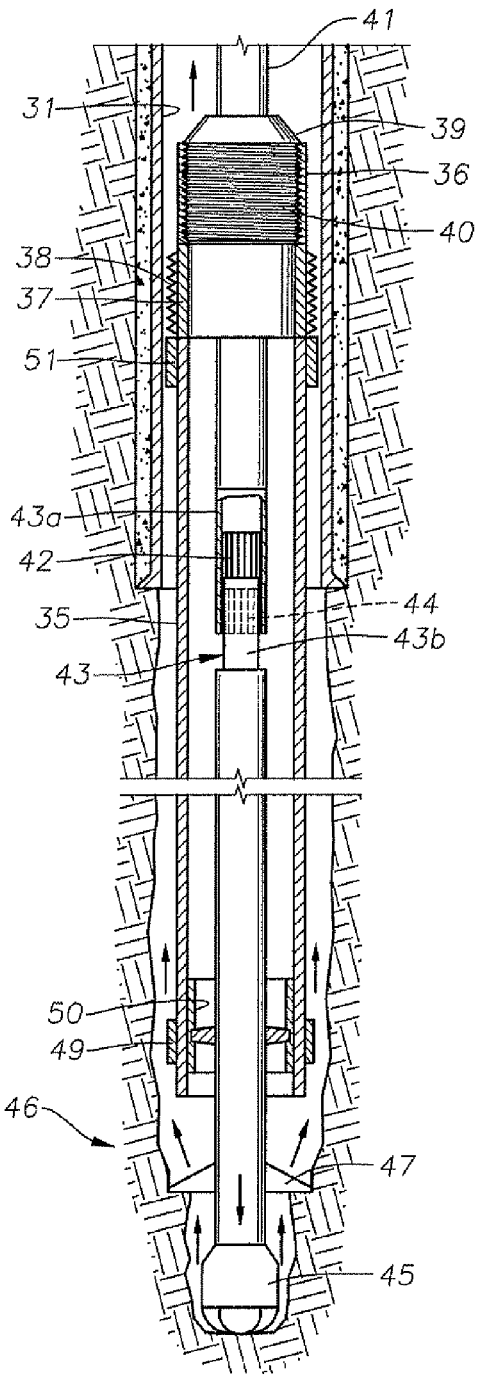

As illustrated in FIGS. 1A and 1B, the operator has drilled through inner wellhead housing 19 and casing 21 to a deeper depth and installed a third string of casing 31. The upper end of casing 31 is supported in inner wellhead housing 19 by a casing hanger 33 that also includes a casing hanger seal or packoff. Casing strings 17, 21 and 31 are cemented in the well. Additional or fewer strings of casing might be installed in the well and supported by casing hangers in wellhead housing 19.

A liner 35 is shown being installed while drilling the well below the last string of casing, which is casing 31 in this example. Liner 35 is made up of casing that has an outer diameter smaller than the inner diameter of casing 31. Liner 35 is installed differently from the other strings of casing in that it will not extend back to subsea wellhead assembly 11. Rather, when the total depth is reached, the upper end of liner 35 will be suspended near the lower end of casing string 31. Typically, liner 35 will extend to the total depth of the well and will be cemented in place.

Liner 35 has an upper sub or liner top assembly 36 with a liner hanger 37 that may be a variety of types. Preferably liner hanger 37 can be actuated into gripping engagement with the inner diameter of casing 31, then released and reset again. Preferably, the setting and releasing cycle can be repeated up to about three times or more. Liner hanger 37 may be constructed similar to a retrievable packer. Liner hanger 37 has gripping members 38 that advance radially outward to grip casing 31 while drilling is not occurring and retract during drilling.

A running tool 39 connects a string of drill pipe 41 to upper sub 36. Preferably, running tool 39 is capable of transmitting torque to the upper sub 36 when drill pipe 41 is rotated to the right in order to rotate liner hanger 37 and liner 35 to the right. Running tool 39 is configured to release from and re-connect to upper sub 36 when desired. In this example, running tool 39 has a set of left-hand threads 40 that secure to an upper portion of liner hanger 37. The joints of drill pipe 41 are connected by conventional right-hand threaded connections, however the torque to loosen the connections of individual sections of drill pipe 41 will be much higher than the left-hand threads 40, so that when drill pipe 41 is rotated to the left, running tool 39 disconnects from upper sub 36.

Alternately, running tool 39 could be secured to and released from upper sub 36 by other mechanical means, such as a J-slot arrangement, or right-hand rotation after lowering drill pipe 41 relative to upper sub 36. Running tool 39 could also be released by dropping a ball or dart through drill pipe 41, which after landing on a seat, releases a locking member in response to hydraulic fluid pressure pumped down drill pipe 41. Regardless of the type of locking engagement, once actuated, it is preferably capable of supporting the weight of liner 35 and transmitting rotation from drill pipe 41 to liner 35.

Drill pipe 41 extends through liner hanger 37 and preferably has a telescoping sub or extension sub 43 connected into it below liner hanger 37. Telescoping sub 43 axially expands and contracts. Also, telescoping sub 43 preferably has a non-torque transmitting mode that allows rotation of the drill pipe 41 above it relative to the drill pipe 41 below it. Telescoping sub 43 has another mode wherein it transmits rotation of the upper portion of drill pipe 41 to the lower portion. In this example, telescoping sub 43 has an upper portion 43*a* and a lower portion 43*b* that axially expand and contract relative to one another. A set of external splines 42 is located on the upper end of lower portion 43*b*. A mating set of internal splines 44 is located in the lower end of upper portion 43*a*. When near or fully extended, splines 42, 44 engage each other to transmit torque from upper portion 43*a* to lower portion 43*b*. When contracted from being near or fully extended, splines 42, 44 will not engage each other, allowing upper portion 42*a* to rotate relative to lower portion 42*b*. Upper and lower portions 43*a* and 43*b* could be inverted.

A bottom hole assembly (BHA) 46, which includes a drill bit 45, is secured to the lower end of drill pipe 41. Drill bit 45 is conventional, and BHA 46 may have a collapsible reamer 47 located above it. Drill bit 45 has an outer diameter slightly less than the inner diameter of liner 35. Reamer 47 has an expanded outer diameter greater than the outer diameter of liner 35.

BHA 46 may include measuring-while-drilling instruments. Furthermore, if employed in a directional well, BHA 46 may include steering equipment and instruments for steering the drill bit 45. Drill bit 45 is shown connected to drill pipe 41 for rotation therewith. A mud motor could also be incorporated with drill bit 45 that rotates drill bit 45 relative to drill pipe 41 in response to drilling fluid pumped down drill pipe 41. Mud motors of this type are particularly employed during directional drilling. A bent sub or angled tubular member could be connected between the mud motor and the bit so that steering of liner 35 could be accomplished by rotating drill pipe 41 and liner 35 a few degrees in a desired direction while pumping drilling fluid down drill pipe 41 to the mud motor to rotate drill bit 45.

BHA 46 includes a latch collar or drill lock assembly 50, which is mounted to drill pipe 41 and engages liner 35 near the lower end of liner 35 for transferring torque from liner 35 to drill pipe 41. As mentioned, preferably torque is transferred from running tool 39 to liner 35 at upper sub 36. Optionally, drill lock assembly 50 axially locks the lower portion of drill pipe 41 to liner 35 so that weight imposed on drill bit 45 is transferred through drill lock assembly 50 to liner 35. Preferably drill lock assembly 50 engages liner 35 by straight downward movement and right-hand turns of drill pipe 41 and disengages by left-hand turns and straight upward pull on drill pipe 41.

A reaming shoe 49 may be secured to the lower end of liner 35. Reaming shoe 49 comprises a collar secured to the lower end of liner 35 and having cutting elements for disintegrating the earth formation. Wear plates 51 are located at various points along the exterior of liner 35 to avoid excessive wear due to contact with casing 31 or the open borehole while liner 35 is rotated.

When it is time to install liner 35, the operator will compute the desired length of liner 35, assemble it and lower it through riser 27. The operator assembles upper sub 36 and liner hanger 37 on the upper end of liner 35. While liner 35 is suspended in the well by slips at the rig floor engaging upper sub 36, the operator assembles BHA 46, lowers drill pipe 41 through liner 35 and connects drill lock assembly 50 to the lower end of liner 35. When some rotation is required of drill lock assembly 50 to connect it to liner hanger 37, the operator can rotate drill pipe 41 and rotation will be transmitted through telescoping sub 43 to drill lock assembly 50 because until drill lock assembly 50 is connected, telescoping sub 43 will be in the extended position due to the weight of drill pipe 41.

The operator connects running tool 39 to upper sub 36, such as by threads 40. Lowering drill pipe 41 a short distance causes telescoping sub 43 to axially contract, releasing splines 42 from splines 44. This releasing step allows the operator to rotate running tool 39 relative to liner without rotating drill lock assembly 50.

The operator continues connecting additional joints of drill pipe 41 and lowers drill pipe 41 and liner 35 into the well. Drill bit 45 will contact the bottom of the well bore at the lower portion of third casing string 31. Typically, a drillable cement shoe will be located at that point. The operator drills through the cement shoe and continues drilling by rotating drill pipe 41 as shown in FIG. 1B and/or operating a mud motor to rotate drill bit 45. Liner 35 will rotate along with drill pipe 41. The operator pumps drilling fluid down drill pipe 41. The drilling fluid can flow up around liner 35, as shown, or some or all of it may flow up the interior of liner 35 and into casing 31.

Figure 2:
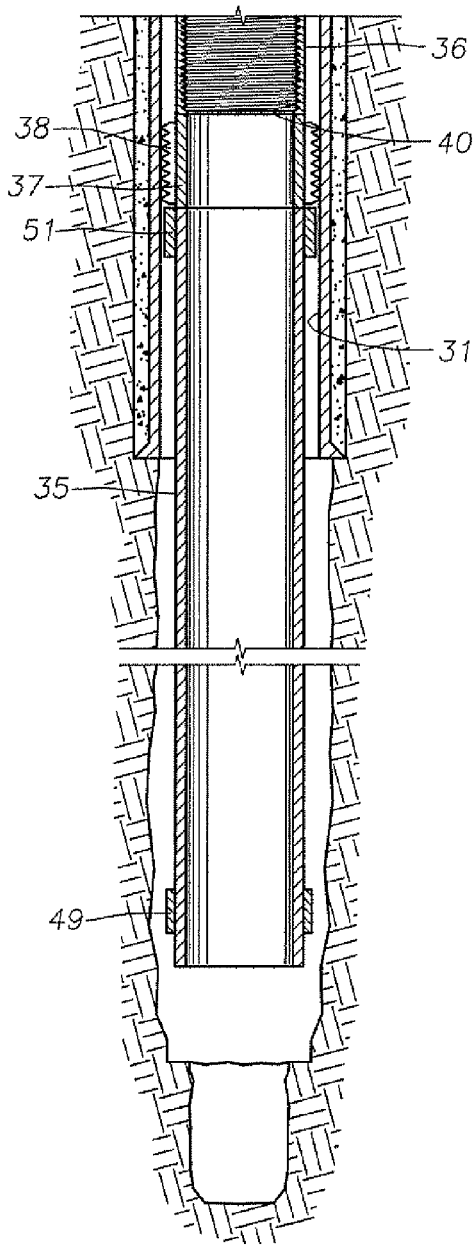
FIG. 2 is a schematic view illustrating the well of FIG. 1, with the liner temporarily hung off to retrieve the bottom hole assembly.

If prior to reaching total depth, the operator wishes to change out drill bit 45 or another downhole tool, the operator will actuate liner hanger 37 to move gripping members 38 out into engagement with casing 31. This may be performed hydraulically by dropping a ball or dart onto a seat in liner hanger 37, then pumping drilling fluid. After ceasing to pump into drill pipe 41, the operator would release running tool 39 from its engagement with upper sub 36, such as by rotating drill pipe 41 to the left to release threads 40. Only the portion of drill pipe 41 above telescoping sub 43 will rotate because telescoping sub 43 is not in the fully extended position. The operator then lifts drill pipe 41, which releases BHA 46 from liner 35, and retrieves BHA 46 to the surface. Liner 35 remains suspended above the borehole bottom as illustrated in FIG. 2.

The operator then runs back into the well with one or more components of BHA 46 repaired or replaced, and reconnects drill lock assembly 50 with the lower portion of liner 35 in the same manner as originally performed. The operator connects running tool 39 to upper sub 36, such as by rotation as previously mentioned. The operator releases gripping members 38 from engagement with casing 31, preferably by straight upward pull. The operator continues drilling with BHA 46, as shown as in FIG. 3. The operator may be able to drill to total depth without changing out BHA 46, or more than one change-out may be required.

Figure 3:
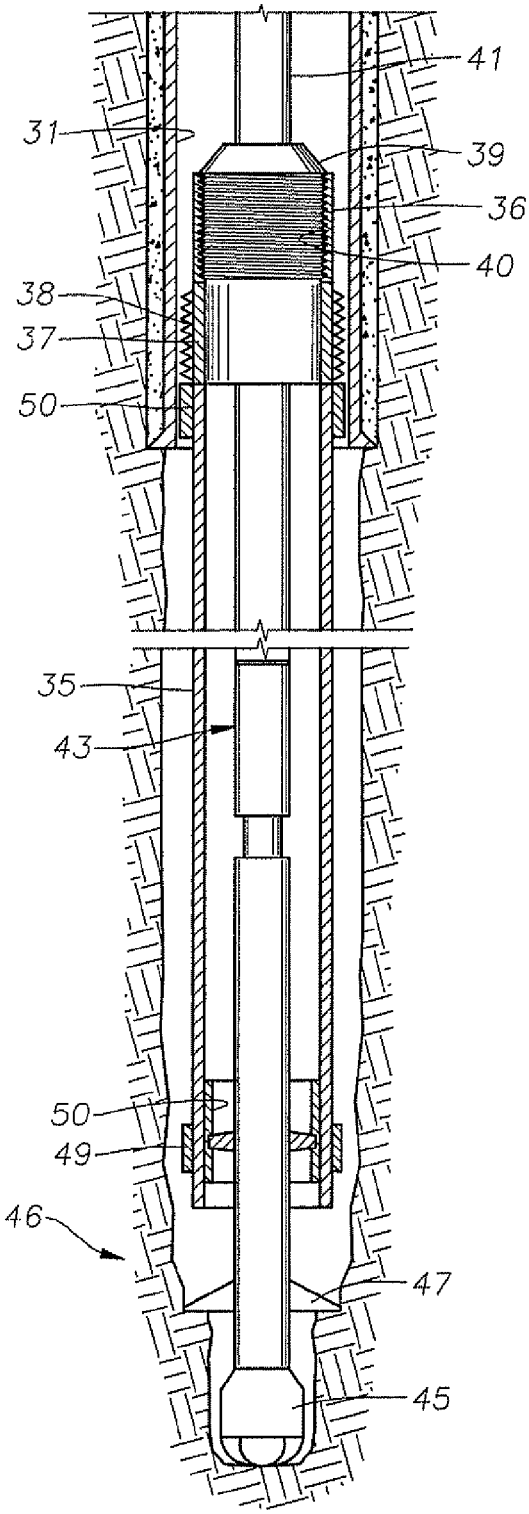
FIG. 3 is a schematic view of the system of FIG. 1, showing the drill pipe and bottom hole assembly reconnected with the liner and drilling deeper into the well.

When at the total depth, as illustrated in FIG. 3, liner hanger 37 will be near the lower end of casing 31. The operator again releases drill lock assembly 50 from liner 35 and actuates gripping members 38 of liner hanger 37 to grip casing 3 1. The operator disconnects running tool 39 from upper sub 36 and retrieves BHA 46 with drill pipe 41.

Figure 4:
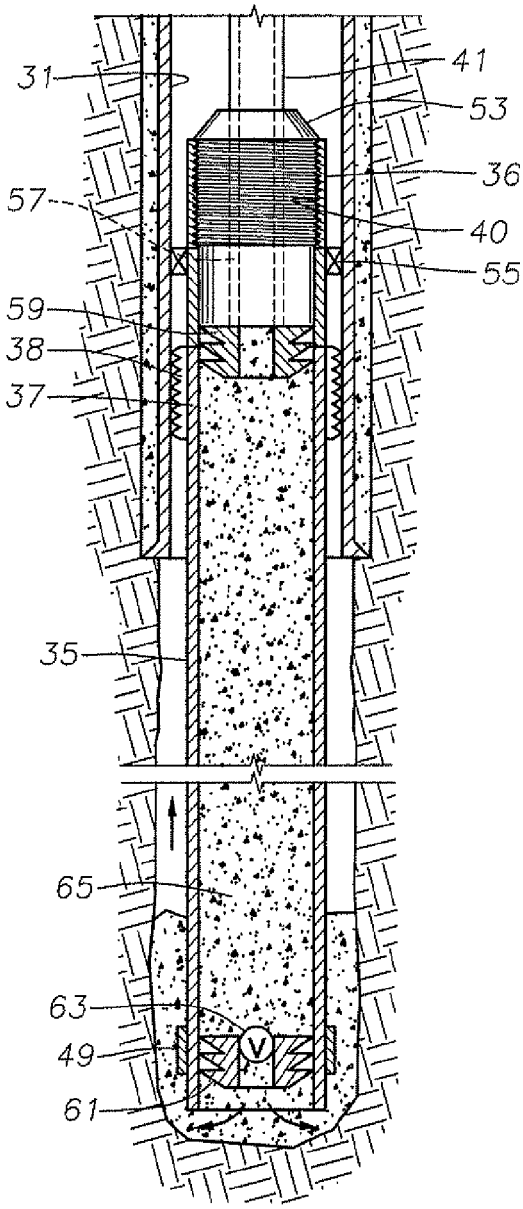
FIG. 4 is a schematic view of the system of FIG. 1, showing the liner hung off at total depth and undergoing cementing.

Referring to FIG. 4, the operator disconnects BHA 46, then secures a running or cementing tool 53 and optionally a liner top packer 55 to drill pipe 41. Liner top packer 55 has a metal tubular body with threads that engage threads 40 of upper sub 36 to connect it to upper sub 36. Liner top packer 55 has an elastomeric element that is set conventionally, such as by dropping a ball or dart, then applying fluid pressure to the interior of drill pipe 41.

Cementing tool 53 has a tubular mandrel 57 that supports an upper cement plug 59 and a lower cement plug 61. Each cement plug 59, 61 may have a seat for a ball or dart to be dropped into drill pipe 41 and landed, enabling increased fluid pressure to release and pump down cement plug 59 or 61. Lower cement plug 61 has a retainer that engages a profile within the lower portion of liner 35 to prevent upward movement. Preferably, the profile exists within liner 35 near its lower end. The profile may be an annular groove that is engaged by an engaging member on lower plug 61. For example, the engaging member could be an outward biased split ring that springs outward into the groove. Lower cement plug 61 may have a flapper valve 63 that allows the ball or dart to be pumped through after lower cement plug 61 lands at the lower end of liner 35. Flapper valve 63 would prevent upward flow. Alternately, rather than flapper valve 63, lower cement plug 61 could have a burst disk that breaks after cement plug 61 lands to enable cement to be pumped through. In that instance, upper cement plug 61 could have a stab-in portion that plugs and seals into the passage in lower cement plug to prevent backflow of cement.

Figure 5:
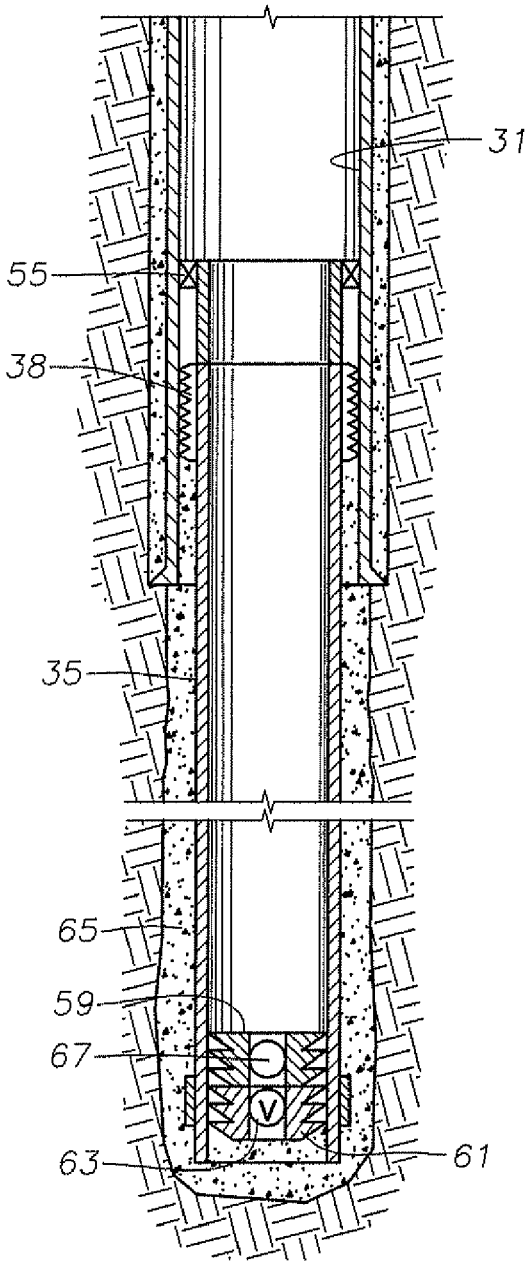
FIG. 5 is a schematic view of the installed liner with the cementing tool retrieved.

The operator runs cementing tool 53 into casing 31 and connects liner top packer 55 to threads 40 by right-hand rotation. While cementing in this example, there will be no drill pipe within liner 35. The operator may circulate drilling fluid through cementing tool 53 and liner top packer 55, which will be in a contracted position, and down liner 35. The drilling fluid returns up the annulus surrounding liner 35. The operator then pumps down lower cement plug 61, which latches into a profile at the lower end of liner 35. The operator pumps cement through lower cement plug 61, which flows back up the annulus around liner 35. as shown in FIG. 4. The returns, which comprise the drilling fluid in the annulus, are displaced upward through flow-by slots in liner hanger gripping members 38. When the desired amount of cement has been dispensed, the operator pumps a dart or ball down drill pipe 41, which wipes drill pipe 41 free of cement and lands on a seat in upper cement plug 63. Continued pressure pumps upper cement plug 63 into engagement with lower cement plug 61, as shown in FIG. 5.

The operator may then set liner top packer 55, which forms a seal between its metal body and the inner wall of casing 31. This is accomplished by dropping a ball or dart of larger diameter than the objects dropped to release upper and lower cement plugs 59, 61, then applying fluid pressure to the interior of drill pipe 41. Afterward, the operator releases cementing tool from the body of liner top packer 55 and retrieves it as illustrated in FIG. 5.

Figure 6:
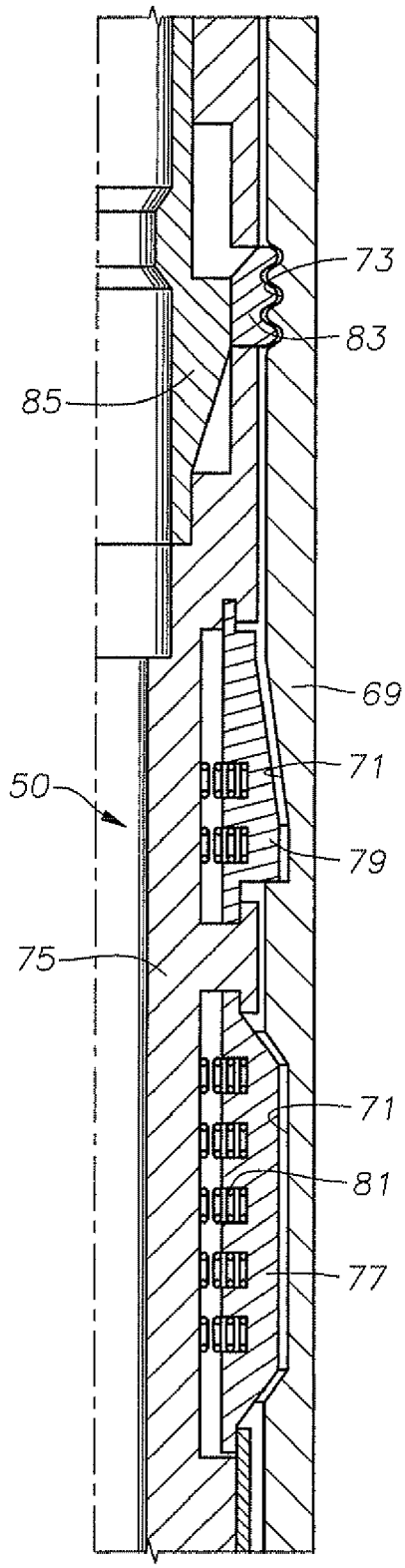
FIG. 6 is an enlarged simplified sectional view of a portion of the bottom hole assembly locking device of the system of FIG. 1.

Referring to FIG. 6, one embodiment of drill lock assembly 50 for securing drill pipe 41 (FIG. 1A) to the lower portion of liner 35 is illustrated. A lower sub 69 is attached to the lower end of liner 35 (FIG. 1). Lower sub 69 is a tubular member having at least one set of torque transmitting shoulders, which in this embodiment comprises axial grooves 71 spaced circumferentially around the inner diameter of lower sub 69. This embodiment shows two sets of axial grooves 71, one set above the other. Lower sub 69 may also contain a set of circumferential grooves 73, which are shown above both sets of axial grooves 71.

Drill lock assembly 50 has an inner body 75 that is tubular and has a passage through it for the passage of drilling fluid. Inner body 75 is connected into the string of drill pipe 41 above the portion of BHA 46 (FIG. 1B) that contains drill bit 45 and optionally various instruments. Inner body 75 has at least one set of torque keys 77. In this embodiment, two sets 77, 79 are illustrated. Torque keys 77 and 79 are biased outward by a plurality of springs 81. Springs 81 cause torque keys 77, 79 to snap outward into engagement with axial grooves 71 when drill lock assembly 50 reaches the proper axial position. The rotation of liner 35 causes inner body 75 to rotate because of the torque keys 77, 79, which in turn causes drill bit 45 (FIG. 1B) to rotate.

An optional locking member 83 will axially lock drill lock assembly 50 to lower sub 69 so that the weight on liner 35 transmits to BHA 46. Locking member 83 comprises a plurality of dogs that carried on the exterior of drill lock assembly 50 and move between a retracted position and an extended position, which is shown. In the extended position, a profile on the outer side of each dog 83 engages circumferential groove 73. A cam 85 is coupled with drill pipe 41 such that lowering drill pipe 41 after drill lock assembly 50 has landed at the proper point in lower sub 69 causes cam 85 to move downward. Cam 85 pushes dogs 83 outward into engagement with circumferential grooves 73. Lifting drill pipe 41 (FIG. 1) lifts cam 85 relative to the portion of drill lock assembly 50 containing dogs 83, freeing dogs 83 to move to the retracted position when inner body 75 is pulled upward with the drill pipe. In some applications, an axial lock is not necessary since the fluid pressure of the drilling fluid flowing through drill lock assembly 50 will hold it in engagement with lower sub 69.

FIGS. 7-9 illustrate one type of resettable liner hanger 37. The assembly of liner hanger 37 includes a tubular housing 87 with a bore 89 that registers with the bore of drill pipe 41. An upward facing seat 91 is located in bore 89. Housing 87 has a plurality of exterior recesses 93 (only one shown), each containing part of a gripping member 97. Each recess 93 has an downward and outward facing load shoulder 95 on the upper end of recess 93. The lower end of recess 93 may be perpendicular to the axis of housing 87.

A plurality of pistons 99 (only one shown in FIG. 7) are mounted in separate holes 103 spaced circumferentially around the inner diameter of bore 89. Each piston 99 has a rod 101 on its inner side that extends through a smaller diameter portion of hole 103 into contact with the inner side of gripping member 97. Hole 103 has a counterbore for piston 99, and a seal will be located on piston 99 to cause it to move radially outward into response to increased fluid pressure within bore 89. A spring 105 is located between the base of the counterbore of hole 103 and piston 99. Spring 105 urges piston 99 inward. Increasing fluid pressure in bore 89 over that on the exterior of housing 87 thus causes pistons 99 to push gripping member 97 outward to the engaged position shown in FIG. 9.

In the preferred embodiment, gripping member 97 comprises a split ring as shown in FIG. 8. Gripping member 97 has a plurality of fingers 107 that are spaced apart from each other by slots 109. Slots 109 extend downward from the upper edge a selected distance. Channels 111 are located between each finger 107 in the lower portion of gripping member 97. Although not shown, a portion of housing 87 will slide into channels 111 between fingers 107 so that gripping member 97 rotates in unison with housing 87. One or more pistons 99 are positioned radially inward from each finger 107 for pushing fingers 107 outward.

When in the outer position shown in FIG. 9, the weight of the liner acts through shoulder 95 against the upper end of gripping member 97 as indicated by the arrow. This weight has an outward directed component that prevents gripping member 97 from retracting in response to spring 105 even when piston 99 retracts inward. Lifting the drill pipe and housing 87 will cause gripping members 97 to retract back into recess 93 because weight will no longer be transferred through shoulder 95 to gripping members 97.

Fluid pressure is preferably applied to bore 89 by dropping an object such as a ball or dart 113 down drill pipe 41 (FIG. 1). Dart 113 lands on seat 91 as shown in FIG. 9 and seals against seat 91. Pumping fluid down the drill pipe 41 (FIG. 1) will increase the pressure in bore 89 above dart 113 so as to cause pistons 99 to move outward. If desired, more than one locking member 97 may be employed, each axially spaced apart from the other. When re-setting liner 37, if one locking member 97 failed to energize and grip the casing, others would serve as a backup.

While the invention has been shown in only a few of its forms, it should be apparent to those skilled in the art it is not so limited, but is susceptible to various changes without departing from the scope of the invention.

The invention claimed is:

1. A method of installing a liner in a well, comprising:

(a) making up a string of liner with a bottom hole assembly sub on a lower end;

(b) making up a string of drill pipe with a bottom hole assembly, including a drill bit on a lower end, and a telescoping sub having an adjustable length above the bottom hole assembly, wherein the telescoping sub has upper and lower portions that are axially movable relative to each other, the telescoping sub having a non-torque transmitting mode wherein the upper portion is rotatable relative to the lower portion and a torque transmitting mode wherein rotation of the upper portion causes rotation of the lower portion, (c) lowering the drill pipe, the bottom hole assembly and the telescoping sub into the liner, and engaging the bottom hole assembly with the bottom hole assembly sub such that torque may be transmitted between the bottom hole assembly and the bottom hole assembly sub;

(d) connecting a running tool to the drill pipe, adjusting the length of the telescoping sub so as to align the running tool with an upper end of the liner, placing the telescoping sub in the non-torque transmitting mode, engaging the running tool with the upper end of the liner such that the running tool supports the weight of the liner and torque may be transmitted between the liner and the running tool;

(e) making up additional drill pipe to the running tool and lowering the liner on the drill pipe through previously installed casing of the well;

(f) rotating the drill bit to drill the wellbore deeper and advancing the liner deeper into the wellbore;

(g) when at a desired depth, disengaging the bottom hole assembly from the bottom hole sub and the running tool from the liner and retrieving the bottom hole assembly and the running tool; and (h) cementing the liner in the wellbore.

2. The method according to claim 1, wherein engaging the bottom hole assembly with the bottom hole sub in step (b) comprises moving the drill pipe straight downward and engaging torque keys of the bottom hole sub with torque slots in the sub, and if needed to cause the torque keys to engage the torque slots, placing the telescoping sub in the torque transmitting mode and rotating the drill pipe to cause the bottom hole assembly to rotate.

3. The method according to claim 1, wherein step (f) comprises rotating the drill string and the liner to cause the drill bit to rotate.

4. The method according to claim 1, wherein step (d) comprises positioning the upper and lower portions axially relative to each other to align the running tool with the liner hanger, and rotating the running tool to engage the liner while the telescoping sub is in the non-torque transmitting mode.

5. The method according to claim 1, wherein step (h) comprises:

attaching to the drill pipe a cementing tool, lowering the cementing tool on the drill pipe and engaging the cementing tool with the upper end of the liner; and pumping cement through the drill pipe, down the liner and up an annulus surrounding the liner.

6. The method according to claim 1, wherein step (h) comprises:

attaching to the drill pipe a cementing tool having upper and lower cement plug members, lowering the cementing tool on the drill pipe and engaging the cementing tool with the upper end of the liner;

pumping the lower cement plug member down from the cementing tool into engagement with the bottom hole assembly sub;

pumping cement through the drill pipe, down the liner, through the lower cement plug member and up an annulus surrounding the liner; and pumping down the upper cement plug member following the cement.

7. A method of installing a liner in a well, comprising:

(a) making up a string of liner with a latch collar at a lower end and a liner top assembly on an upper end, the liner top assembly including a liner hanger;

(b) making up a string of drill pipe with a bottom hole assembly including a drill bit on a lower end and an extension joint above the drill bit, the extension joint having upper and lower portions that are axially movable relative to each other, the extension joint having a torque transmitting mode when fully extended wherein rotation of the upper portion causes rotation of the lower portion and a non-torque transmitting mode when not fully extended wherein the upper portion is rotatable relative to the lower portion; and (c) lowering the drill pipe and the bottom hole assembly into the liner, and engaging the bottom hole assembly with the latch collar;

(d) connecting a running tool to the drill pipe and engaging the running tool with the liner top assembly such that the running tool supports the weight of the liner and the extension joint is in the non-torque transmitting mode;

(e) making up additional drill pipe to the running tool and lowering the liner on the drill pipe through previously installed casing of the well;

(f) rotating the drill bit to drill the wellbore deeper and advancing the liner deeper into the wellbore;

(g) if repair of replacement of components of the bottom hole assembly is required before reaching a desired depth, actuating the liner hanger to grip the casing and support the weight of the liner, disengaging the running tool from the liner top assembly and retrieving the bottom hole assembly with the drill pipe; and (h) re-running the bottom hole assembly on the drill pipe back into the liner and re-engaging the inner string with the latch collar, re-engaging the running tool with the liner top assembly, releasing the liner hanger from engagement with the casing, and again commencing drilling of the wellbore.

8. The method according to claim 7, further comprising:

when at the desired depth, re-engaging the liner hanger with the casing and retrieving the drill pipe, running tool and bottom hole assembly;

attaching to the drill pipe a cementing tool, lowering the cementing tool on the drill pipe and engaging the cementing tool with the liner top assembly; and pumping cement through the drill pipe, down the liner and up an annulus surrounding the liner.

9. The method according to claim 7, further comprising:

when at the desired depth, re-engaging the liner hanger with the casing and retrieving the drill pipe, running tool and bottom hole assembly;

attaching to the drill pipe a cementing tool and a packer, lowering the cementing tool and the packer on the drill pipe and engaging the cementing tool and the packer with the upper sub;

pumping cement through the drill pipe, down the liner and up an annulus surrounding the liner;

setting the packer to seal between the liner and the casing; and retrieving the cementing tool.

10. The method according to claim 7, further comprising:

when at the desired depth, re-engaging the liner hanger with the casing and retrieving the drill pipe, running tool and bottom hole assembly;

attaching to the drill pipe a cementing tool having upper and lower cement plug members, lowering the cementing tool on the drill pipe and engaging the cementing tool with the upper sub;

pumping the lower cement plug member down from the cementing tool into engagement with the bottom hole assembly sub;

pumping cement through the drill pipe, down the liner, through the lower, cement plug member and up an annulus surrounding the liner; and pumping down the upper cement plug member following the cement.

11. The method according to claim 7, wherein step (g) comprises applying hydraulic fluid pressure to the interior of the drill pipe to cause the liner hanger to grip the casing.

12. The method according to claim 7, wherein step (g) comprises:

applying hydraulic fluid pressure to the interior of the drill pipe to cause a gripping member of the liner hanger to move radially outward from the liner hanger to grip the casing;

lowering the drill pipe to transfer the weight of the liner from the running tool to the gripping member and ceasing to apply the hydraulic fluid pressure; and disconnecting the running tool from the upper sub.

13. The method according to claim 12, wherein releasing the liner hanger from engagement with the casing in step (h) comprises lifting the liner with the drill pipe, thereby allowing the gripping member to retract.

14. The method according to claim 7, wherein:

engaging the running tool with the liner hanger in step (d) comprises rotating threads of the running tool into engagement with threads in the upper sub; and disengaging the running tool from the liner hanger in step (g) comprises rotating the threads of the running tool in an opposite direction to the direction in step (d).

15. The method according to claim 7, wherein in step (h), the extension joint is in the torque transmitting mode prior to re-engaging the bottom hole assembly with the latch collar, such that rotation of the drill pipe may be made to cause rotation of the bottom hole assembly.

16. The method according to claim 7, wherein:

step (d) comprises positioning the upper and lower portions of the extension joint axially relative to each other to align the running tool with a mating profile in the upper sub, and rotating the running tool to engage the liner while the extension joint is in the non-torque transmitting mode.

17. The method according to claim 16, wherein the extension joint is in torque transmitting mode while performing step (c).

* * * * *